US012023541B2

(12) United States Patent
Simenthi

(10) Patent No.: US 12,023,541 B2
(45) Date of Patent: Jul. 2, 2024

(54) FULL BODY FITNESS EQUIPMENT

(71) Applicant: I-TECH USA, INC., Farmington Hills, MI (US)

(72) Inventor: Dominic Simenthi, Ernakulam (IN)

(73) Assignee: I-TECH USA, INC., Farmington Hills, MI (US)

( * ) Notice: Subject to any disclaimer, the term of this patent is extended or adjusted under 35 U.S.C. 154(b) by 197 days.

(21) Appl. No.: 17/855,319

(22) Filed: Jun. 30, 2022

(65) Prior Publication Data

US 2023/0001259 A1 Jan. 5, 2023

Related U.S. Application Data

(60) Provisional application No. 63/216,602, filed on Jun. 30, 2021.

(51) Int. Cl.
*A63B 21/00* (2006.01)
*A63B 21/015* (2006.01)
*A63B 21/02* (2006.01)

(52) U.S. Cl.
CPC ..... *A63B 21/153* (2013.01); *A63B 21/015* (2013.01); *A63B 21/023* (2013.01); *A63B 21/4033* (2015.10); *A63B 2225/09* (2013.01)

(58) Field of Classification Search
CPC .... A63B 21/153; A63B 21/154; A63B 21/156
See application file for complete search history.

(56) References Cited

U.S. PATENT DOCUMENTS 2,959,414 A 11/1960 Saltz
4,867,445 A 9/1989 Connelly
6,120,423 A * 9/2000 Mackey ..... A63B 21/153 482/121
6,315,701 B1 * 11/2001 Shifferaw ..... A63B 21/00069 482/110
6,612,170 B2 * 9/2003 Brown ..... A63B 21/4043 73/379.06
8,690,742 B1 4/2014 Herman et al.
8,734,306 B2 5/2014 Dunn
9,149,677 B2 10/2015 Rountree et al.
11,123,609 B2 * 9/2021 Rubin ..... A63B 21/4033
2003/0153441 A1 8/2003 Berns et al.
2015/0080184 A1 * 3/2015 Boyette ..... A63B 71/0619 482/9

(Continued)

FOREIGN PATENT DOCUMENTS

WO 2021046596 A1 3/2021

OTHER PUBLICATIONS

Written Opinion of the International Searching Authority dated Oct. 4, 2022.

*Primary Examiner* — Zachary T Moore

(74) *Attorney, Agent, or Firm* — Jacob M. Ward; Ward Law Office LLC

(57) ABSTRACT

A fitness device includes a main body, a left wing extending outwardly from the main body in a first direction, and a right wing extending outwardly from the main body in a second direction opposite the first direction. A cable extends from the main body to each of the left wing and the right wing. The fitness device further includes a gearbox, a spool assembly connected to an input end of the gearbox, a brake assembly connected to an output end of the gearbox, and a pulley assembly.

17 Claims, 13 Drawing Sheets

(56) References Cited

U.S. PATENT DOCUMENTS

| | | | | |
|---|---|---|---|---|
| 2016/0332019 | A1* | 11/2016 | Rollins | A63B 23/129 |
| 2023/0201652 | A1* | 6/2023 | Ye | A63B 23/03541 482/133 |
| 2023/0405404 | A1* | 12/2023 | Belsham | A63B 21/4035 |

* cited by examiner

FULL BODY FITNESS EQUIPMENT

CROSS-REFERENCE TO RELATED APPLICATIONS

This application claims the benefit of U.S. Provisional Application Ser. No. 63/216,602, filed on Jun. 30, 2021. The entire disclosure of the above application is incorporated herein by reference.

FIELD

The present invention relates generally to fitness and, more particularly, to a fitness device, a fitness system, and a method for using a fitness device.

INTRODUCTION

This section provides background information related to the present disclosure which is not necessarily prior art.

The global fitness industry is a multibillion dollar industry. Fitness enthusiasts may consider joining fitness clubs in order to access a variety of equipment and workout classes for a total body workout. However, fitness clubs are often expensive and crowded. Additionally, it may be inconvenient and inefficient to spend time traveling to and from a fitness club during designated hours. Accordingly, home fitness equipment has been highly sought after in recent years.

Owning fitness equipment at home allows fitness enthusiasts to avoid fitness club membership fees, waiting for equipment during busy gym hours, and wasting time traveling to and from fitness clubs. However, home fitness equipment can be expensive, often takes up a lot of space in a home or office, and is typically limited to a very specific workout type or muscle system. In one particular example, U.S. Pat. No. 8,734,306 teaches a resistance apparatus including a track, a vertical slide, and a resistance band. However, the device is not portable and is limited to a very specific workout. In another example, U.S. Pat. No. 8,690,742 teaches a physical training apparatus including a wall station, a floor station, and a resistance band. However, the apparatus takes up a lot of space and must be mounted to both the floor and the wall. In yet another example, U.S. Pat. No. 9,149,677 teaches exercise equipment that is mounted to a door during use. Undesirably, the equipment offers limited options for customization. Additionally, the equipment requires that a door be available and may cause damage to the door during use.

Accordingly, there is a continuing need for home fitness equipment that is easy to use, store, and transport, and that is low-cost and capable of providing a full body workout. Desirably, the home fitness equipment is durable, customizable, and fun to use.

SUMMARY

In concordance with the instant disclosure, a fitness device that is easy to use, store, and transport, and that is low-cost, capable of providing a full body workout, durable, customizable, and fun to use, has surprisingly been discovered.

In certain embodiments, a fitness device includes a main body, a left wing extending outwardly from the main body in a first direction, and a right wing extending outwardly from the main body in a second direction opposite the first direction. A cable extends from the main body to each of the left wing and the right wing. The fitness device further includes a gearbox, a spool assembly connected to an input end of the gearbox, a brake assembly connected to an output end of the gearbox, and a pulley assembly.

In certain embodiments, a fitness system includes a fitness device, a software application, and a remote device. The fitness device includes a main body, a left wing extending outwardly from the main body in a first direction, and a right wing extending outwardly from the main body in a second direction opposite the first direction. A cable extends from the main body to each of the left wing and the right wing. The fitness device further includes a gearbox, a spool assembly connected to an input end of the gearbox, a brake assembly connected to an output end of the gearbox, and a pulley assembly.

In certain embodiments, a method of using a fitness device comprises the step of providing a fitness device. The fitness device includes a main body, a left wing extending outwardly from the main body in a first direction, and a right wing extending outwardly from the main body in a second direction opposite the first direction. A cable extends from the main body to each of the left wing and the right wing. The fitness device further includes a gearbox, a spool assembly connected to an input end of the gearbox, a brake assembly connected to an output end of the gearbox, and a pulley assembly. Additional steps include positioning the fitness device in a desired location and orientation, securing the fitness device in a selected position, adjusting a setting on the fitness device, and selectively engaging the cable.

In certain embodiments, a fitness device for full body fitness is provided. The fitness device may have a main body, a left wing with a left cable, and a right wing with a right cable. The main body is centrally positioned between the left wing and right wing, such that the left wing and right wing extend out in opposite directions from one another. The main body, the left wing, and/or the right wing may be manufactured from wood, metal, plastic, and/or a composite. However, it should be appreciated that a skilled artisan may employ different materials for constructing the main body, the left wing, and the right wing as desired. The main body may include a gearbox with a gearbox shaft, a spool, and a braking mechanism. The spool may be connected to an input end of the gearbox shaft via a one-way clutch. The left cable and/or the right cable may be wrapped around the spool. The gearbox may be configured to reduce or increase the rotation of the gearbox shaft. The gearbox shaft may be configured to rotate in one direction when a user pulls either or both of the left cable and/or the right cable. The pulling of either or both of the left cable and the right cable unspools the left cable and/or the right cable from about the spool. The one-way clutch may be configured to transmit torque from the user pulling on the left cable and/or the right cable to the gearbox shaft in the one direction while stopping torque transmission in the opposite direction. The gearbox may multiply the torque by a factor of thirty (1:30 ratio). It should be appreciated that a skilled artisan may scale the gearbox ratio to be higher or lower, within the scope of this disclosure. Advantageously, by using the gearbox shaft to rotate both the left cable and/or the right cable, the user may experience resistance uniformly across the left cable and right cable, which may militate against balance issue between left cable and right cable. It should be appreciated that one skilled in the art may employ different technologies for the gearbox shaft, within the scope of this disclosure. The balance is attained by using one brake mechanism for both left and right.

The main body of the fitness device may further include a return spring. The return spring may be configured to wind back the left cable and/or the right cable on the spool without causing the gearbox shaft to rotate in the one direction. The return spring may include a first spring lock and a second spring lock. A center of the return spring may be affixed to the first spring lock via a slot. The first spring lock may be configured to be disposed adjacent to the gearbox shaft. In particular, the first spring lock may be connected to a hole in a back housing of the fitness device and a mounting hole of the gearbox. The second spring lock may be disposed adjacent to the spool. An end of the return spring may be affixed to the second spring lock. When the spool rotates, the end of the return spring also rotates, while the center of the spring remains stationary and affixed to the first spring lock. Desirably, this will cause the return spring to be pulled back once the user stops pulling the left cable and/or the right cable. However, it should be appreciated that a skilled artisan may employ different return mechanisms to wind the left cable and/or the right cable, as desired. Each spool has their own return spring. Within the spool, one end will be connected to the rim of the spool and the other end to the spring lock of the respective spool.

Each of the left cable and the right cable may have a loop, a straight pulley, and an inclined pulley. The loop may be configured to attach to a handle to permit the user to pull the left cable and/or the right cable more easily. A non-limiting example of the loop may include a carabiner. The loop may be connected to the straight pulley and the straight pulley may be connected to the inclined pulley. The inclined pulley may be connected to a central pulley, which connects the left cable and/or the right cable to the spool. Desirably, this allows the left cable and/or the right cable to cause the gearbox shaft to rotate in the one direction when the user pulls on the left cable and/or the right cable. Although this configuration has shown to be useful, it should be appreciated that a person skilled in the art may select different technologies for the cable and the gearbox shaft, as desired.

The braking mechanism may be configured to gradually engage with the gearbox shaft to militate against the gearbox shaft from rotating in the one direction. In certain examples, the braking mechanism may include a friction braking mechanism. The braking mechanism may have a brake disc, a knob, a brake shoe, and a brake liner. The brake disc may be connected to an output end of the gearbox. The brake disc may be configured to receive a brake force, which the gearbox may multiply by a factor of thirty. However, it should be appreciated that one skilled in the art may scale the gearbox ratio higher or lower, as desired. The knob may be manually adjusted by the user to move the brake shoe inward, which may push the brake liner towards the brake disc. This may gradually increase the load on the gearbox, which in turn increases the brake force. The brake force militates against the gearbox shaft from rotating in the one direction. In addition, the brake force generates resistance on the left cable and/or the right cable by militating against the gearbox shaft from rotating in the one direction when the user pulls on the left cable and/or the right cable. Advantageously, the resistance generated by the brake force to the left cable and/or the right cable requires the user to apply additional force when pulling the left cable and/or the right cable, thereby allowing the user to build muscles by pulling with the left cable and/or the right cable. It should be appreciated the braking mechanism may also include other suitable braking technologies and methods. Non-limiting examples may include electric braking technologies, fluid braking technologies, air braking technologies, etc.

In certain embodiments, the gearbox shaft may instead be driven by pulling a single cable instead of the left cable and the right cable. The user may pull the single cable with either the left hand, the right hand and/or in combination to drive the gearbox shaft. It is believed that this may result in a better distribution of the resistance felt on both hands. For example, with the left cable and the right cable, the user may unconsciously pull one of the cables with more force because of a dominant hand. With the single cable, the user may be more likely to apply equal amounts of lifting force.

The fitness device may include at least one sensor. It should be appreciated that a skilled artisan may select the sensor to use based on the data to be collected. The sensors may be configured to measure workout data. Non-limiting examples of the workout data may include a current weight the user is experiencing, a number of rotations of the gearbox shaft, and a speed of the rotation of the gearbox shaft. Desirably, the workout data may be used to determine the intensity of the workout. It should be appreciated that a skilled artisan may select other data to be included in the workout data, as desired.

The sensors may include a contact wiper and a hall sensor with a magnet. The contact wiper may be configured to determine a current position of the knob of the braking mechanism. Advantageously, this may allow the sensors to detect the current weight the user is experiencing by determining the current position of the knob. The magnet may be disposed on the spool. The hall sensor may be configured to detect the presence and magnitude of a magnetic field of the magnet, thereby allowing the number of rotations of the gearbox shaft and the speed of the rotation of the gearbox shaft to be determined by the sensors. It should be appreciated that one skilled in the art may employ different sensor technologies for measuring the workout data, within the scope of this disclosure.

In certain examples, the fitness device may further include a software application. The software application may be configured to receive the workout data from the plurality of sensors and display the workout data to the user. The software application may also be configured to permit the user to interface with the software application to configure settings on the fitness device and/or select predetermined exercise programs. The pre-programmed exercise programs may control the fitness device automatically according to an exercise regimen. For example, the braking mechanism may include a braking motor. The braking motor may be configured to automatically rotate the knob of the braking mechanism to adjust the current weight the user is experiencing according to the exercise program. The software application may include a mobile application, desktop application, a web application, and/or a virtual reality/augmented reality application.

The software platform may be further configured to receive an auditory command from the user. Desirably, the auditory command may be used to control the fitness device. In certain examples, when the software application is a mobile application, the user may transmit the auditory command through a microphone on a mobile device, which the software platform may then use to control the fitness device. For example, the user may use an auditory command to instruct the fitness device to adjust the current weight the user is experiencing via the braking motor moving the knob. It should be appreciated that a skilled artisan may employ different functions and features for the software application, as desired. A microphone may also be incorporated on the fitness equipment itself for fully standalone voice activated workouts without help of a smartphone or mobile application.

The fitness device may further include a speaker. The speaker may be configured to emit audio feedback. For example, the speaker may emit exercise instructions, according to the exercise program. Another example may include emitting music, which the user may listen to while using the fitness device. In certain examples, the speaker may include a wireless speaker. It should be appreciated that a person skilled in the art may utilize the speaker in different ways to enable more features for the fitness device.

The fitness device may include a built-in rechargeable battery. The battery may be used to provide power to the electronic components of the fitness device. It should be appreciated that other power sources may also be utilized, within the scope of this disclosure. In yet further examples, the fitness device may also include various mounting accessories. Advantageously, the mounting accessories may be used to affix the fitness device to the walls, doors, windows, etc. Desirably, this may allow the user to perform exercises where the left cable and/or the right cable is engaged from an elevated position.

In certain embodiments, a method for using the fitness device for full body fitness may include providing the fitness device. The user may selectively pull the left cable and/or the right cable. The gearbox shaft may be rotated in the one direction by the left cable and/or the right cable. The braking mechanism may be gradually engaged with the gearbox shaft, thereby generating a brake force. The brake force may create resistance on the left cable and/or the right cable when pulled by the user.

Advantageously, the fitness device and the method may be used for full body fitness. In addition, the gearbox shaft and the braking mechanism may allow the fitness device to be compact and easy to use. For instance, the gearbox shaft and the braking mechanism may be used in combination to generate resistance without having to use a plurality of free weights. In addition, the fitness device does not require the user to add or remove free weights during a workout, thereby making the workout even easier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
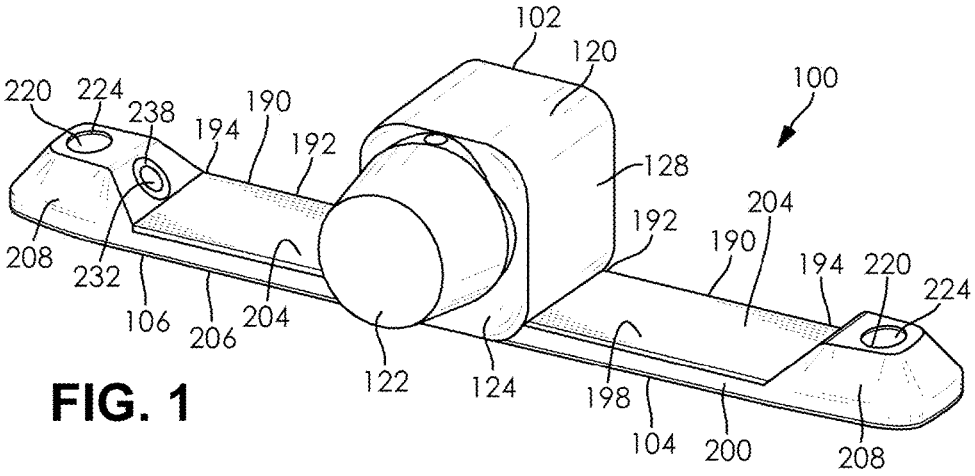
FIG. 1 is a top perspective view of a fitness device, according to an embodiment of the present disclosure.
Figure 2:
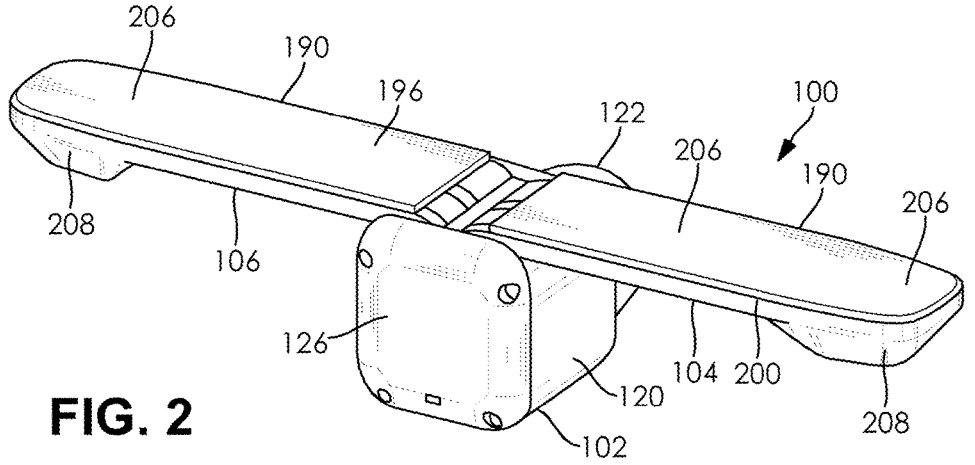
FIG. 2 is a bottom perspective view of the fitness device of FIG. 1.
Figure 3:
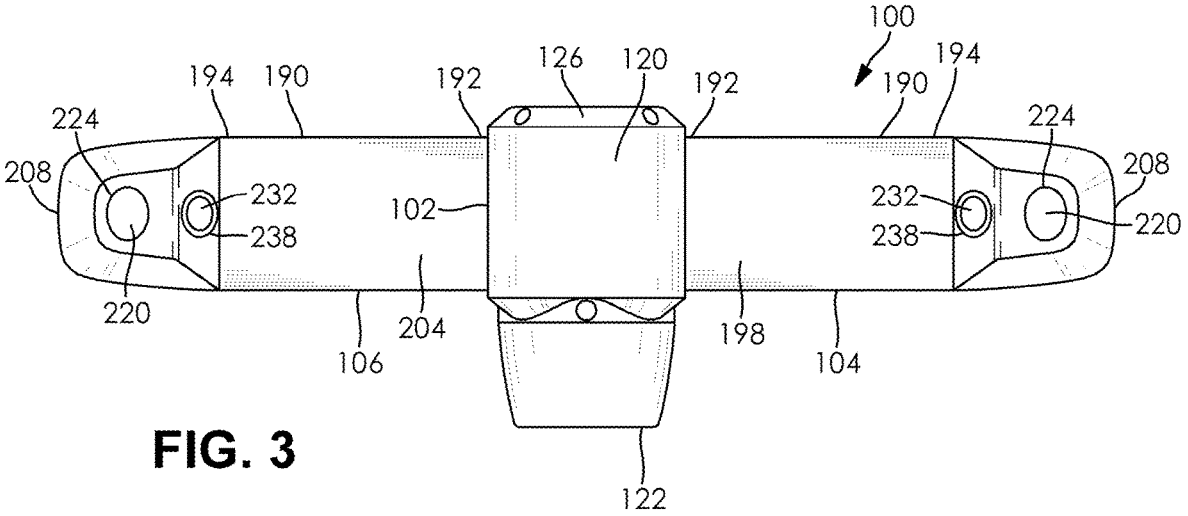
FIG. 3 is a top plan view thereof.
Figure 4:
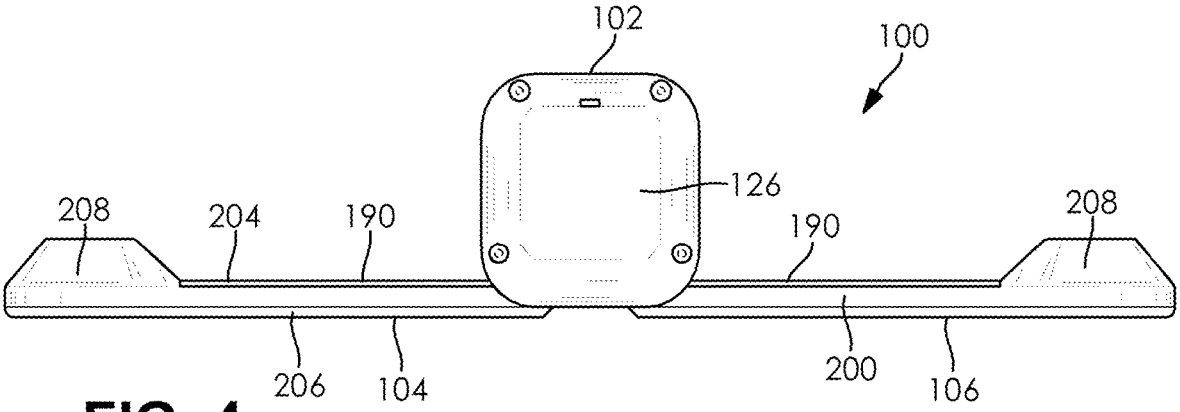
FIG. 4 is a rear elevational view thereof.
Figure 5:
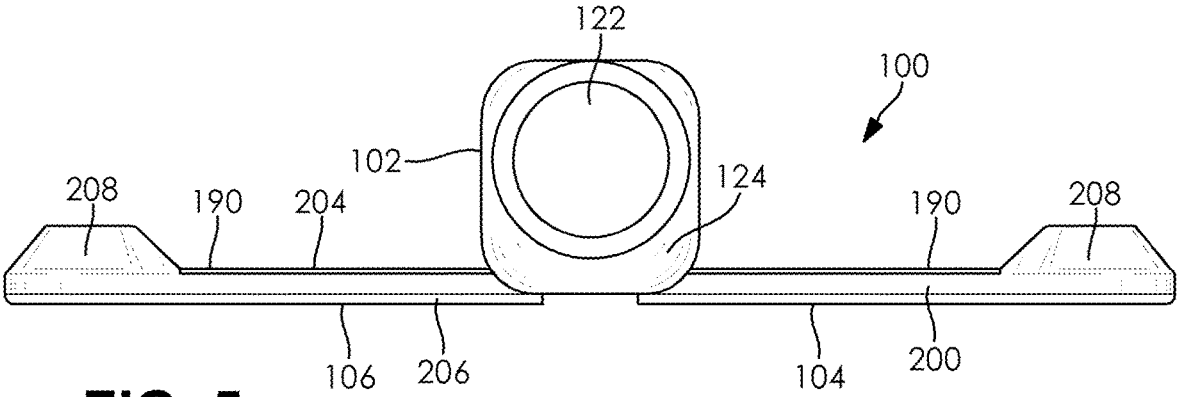
FIG. 5 is a front elevational view thereof.
Figure 6:
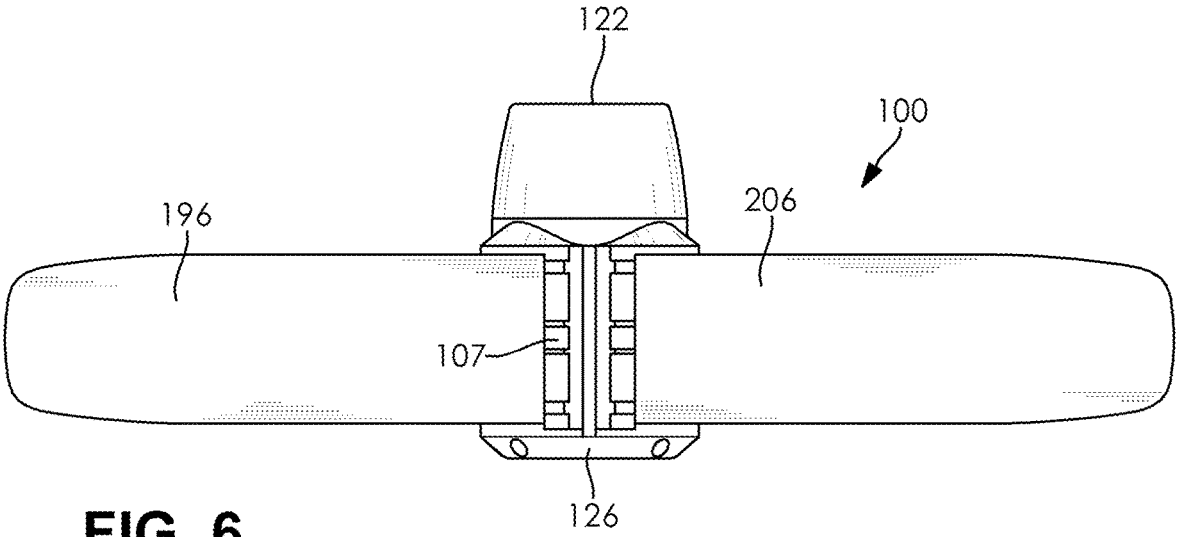
FIG. 6 is a bottom plan view thereof.
Figure 7:
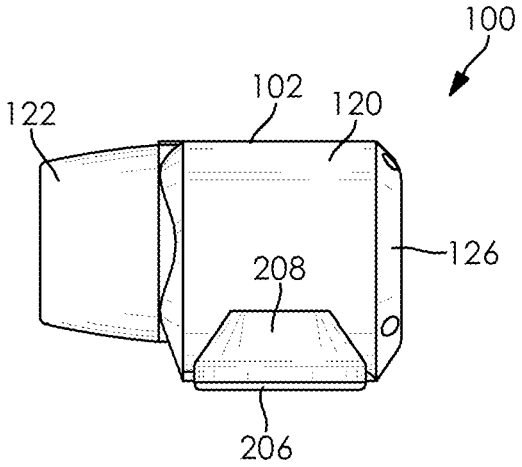
FIG. 7 is a left side elevational view thereof.
Figure 8:
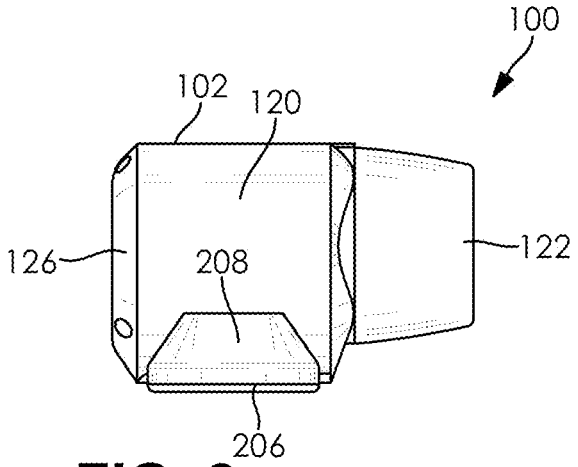
FIG. 8 is a right side elevational view thereof.
Figure 9:
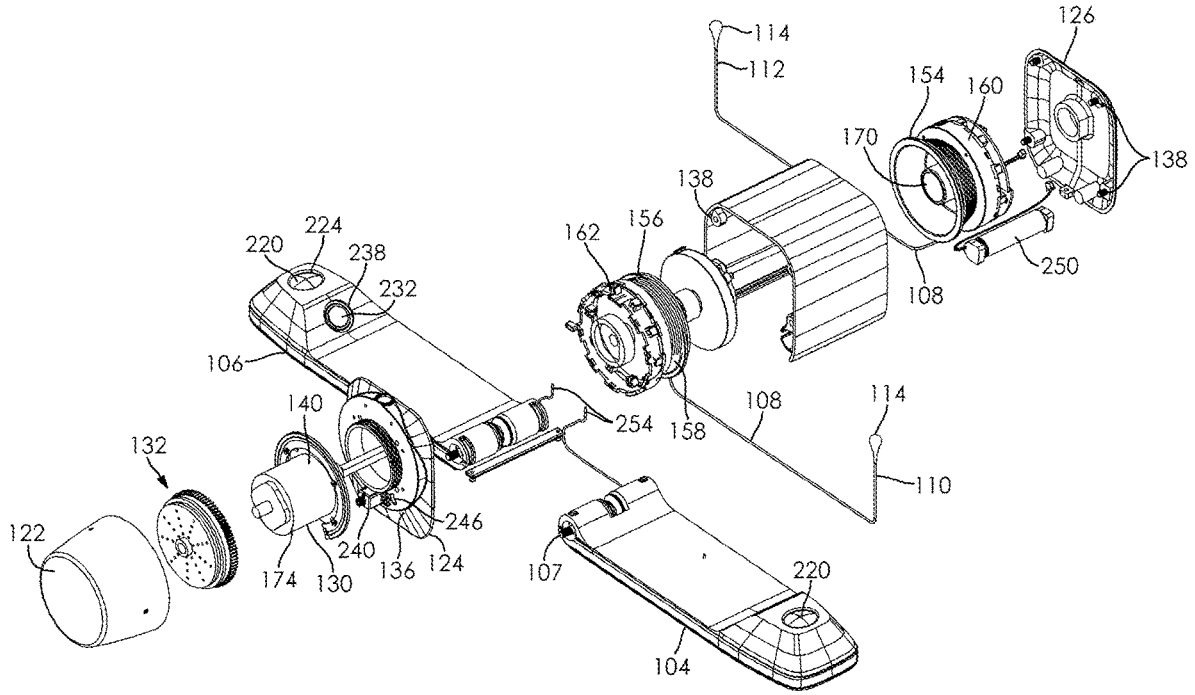
FIG. 9 is an exploded top perspective view of a fitness device, according to an embodiment of the present disclosure.
Figure 14:
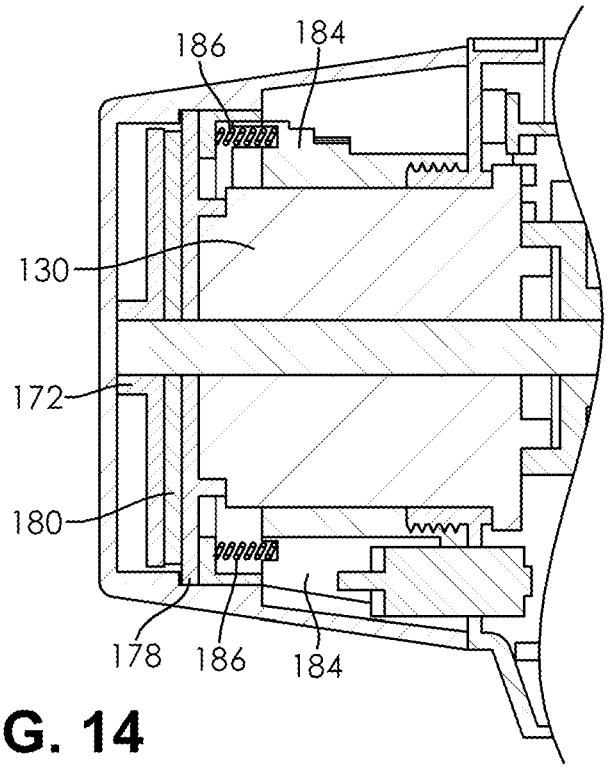
Figure 15:
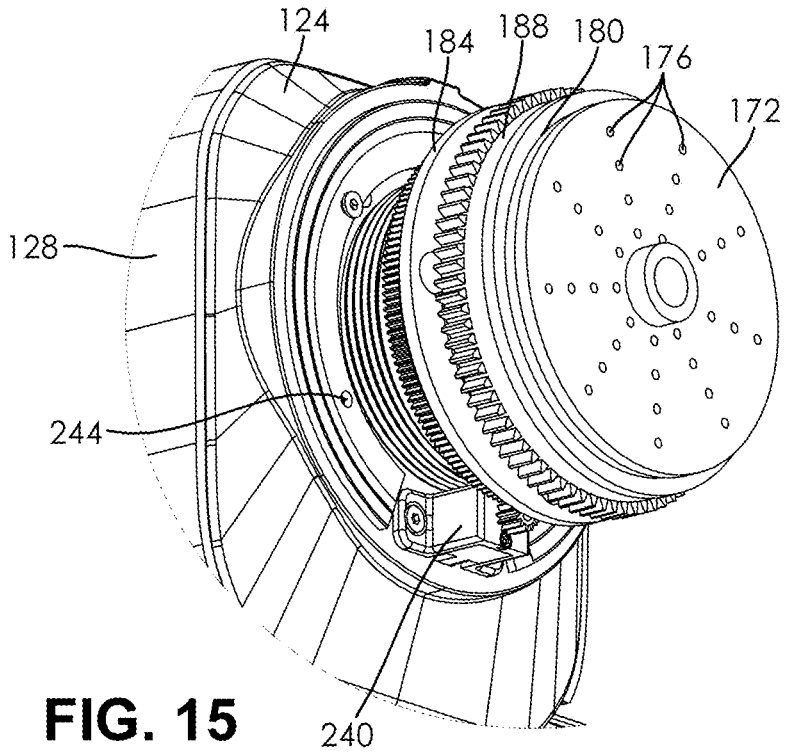
Figure 16:
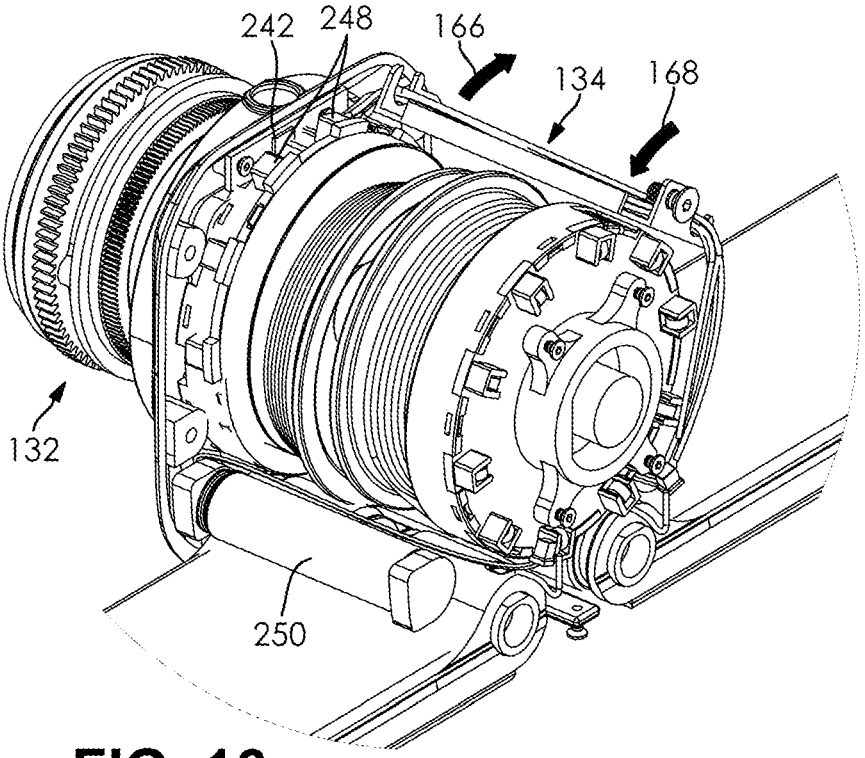
Figure 17:
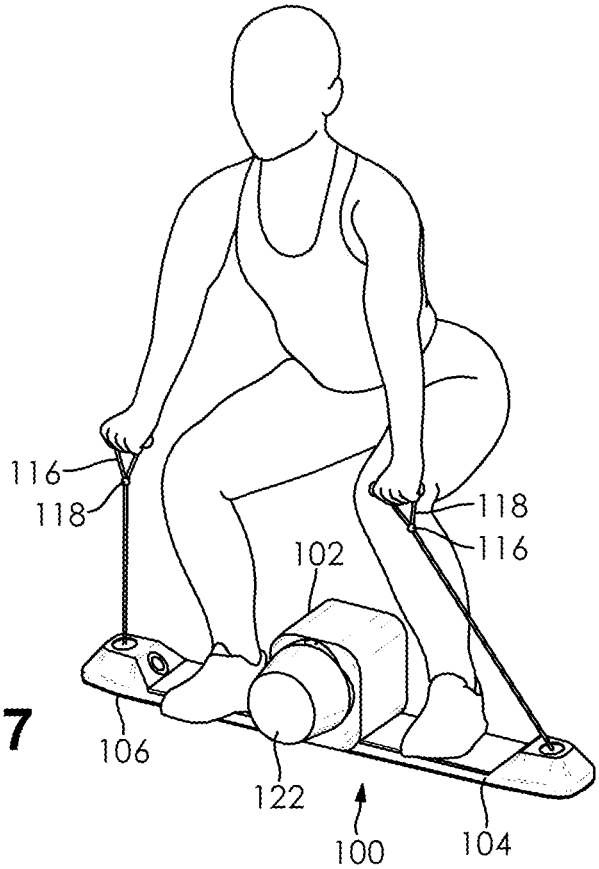
Figure 18:
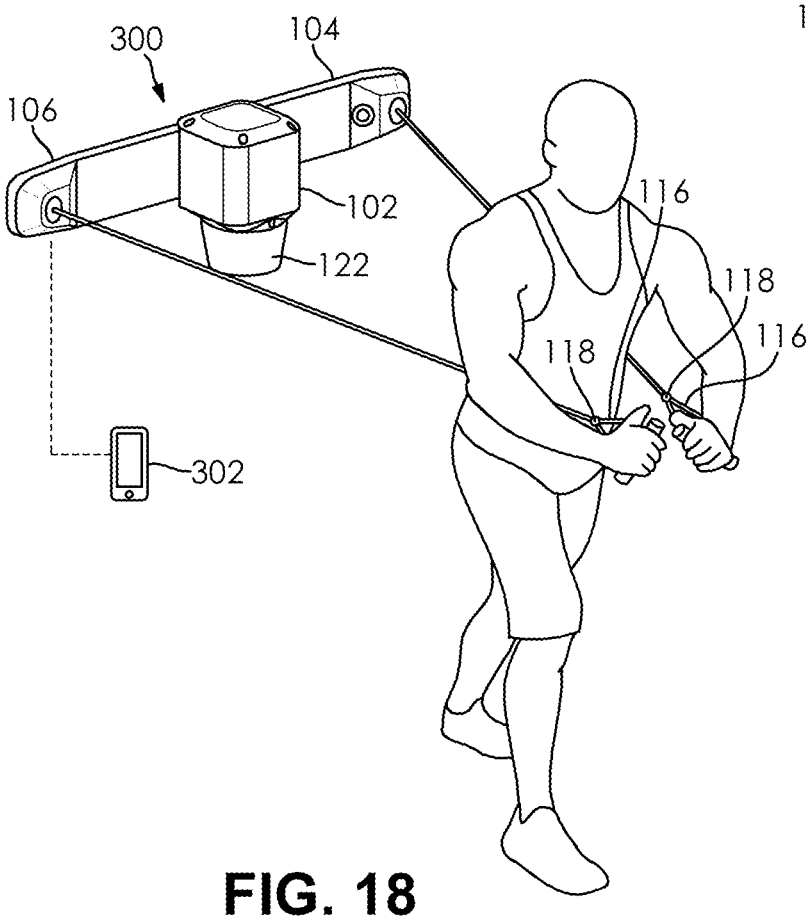
Figure 19:
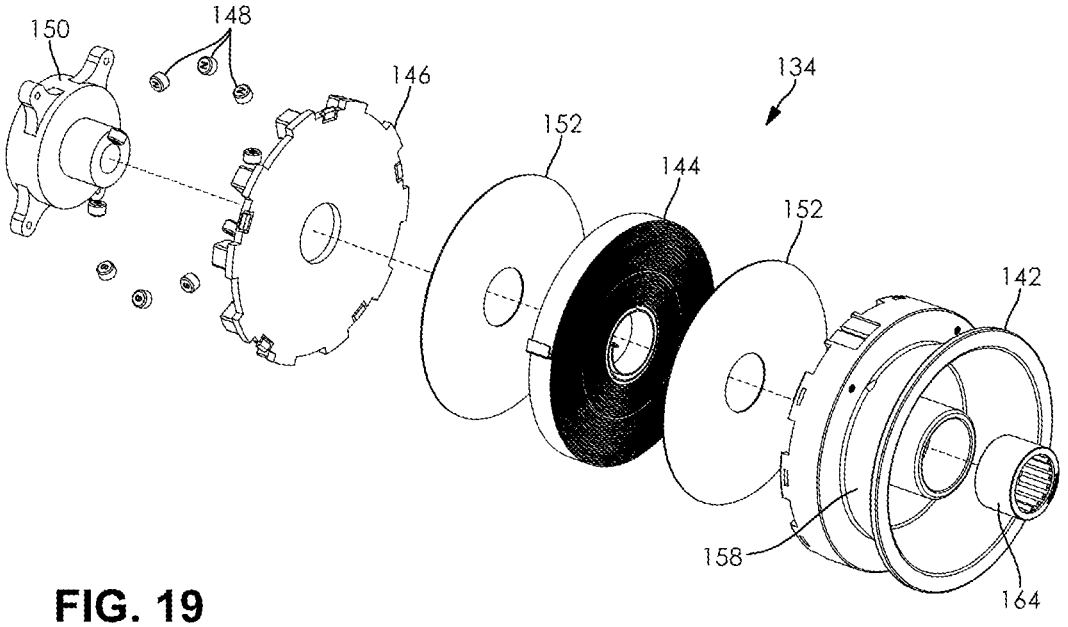
Figure 20:
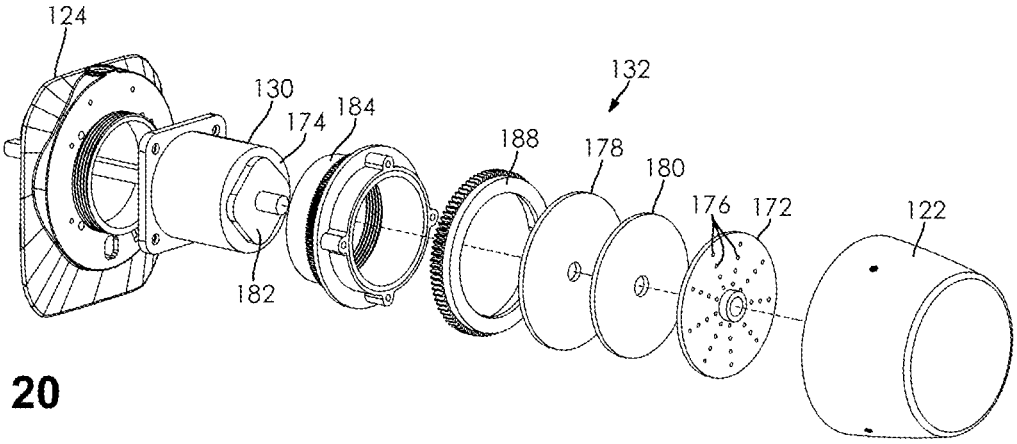
Figure 21:
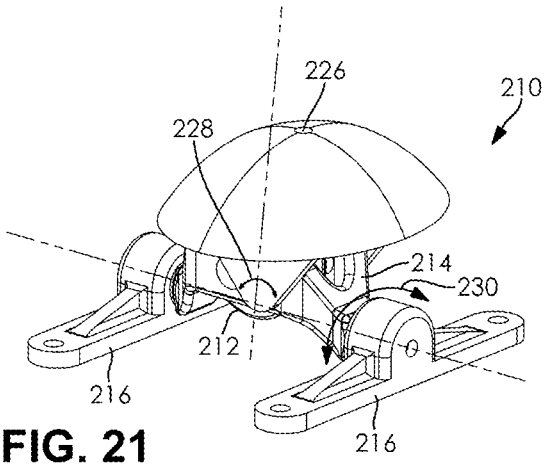
Figure 22:
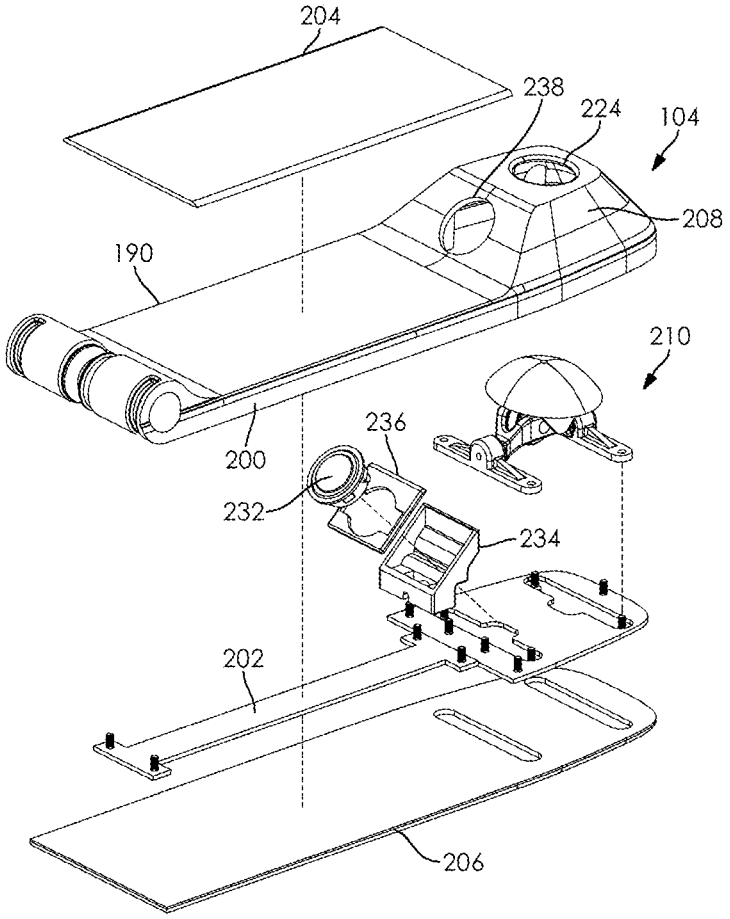
Figure 23:
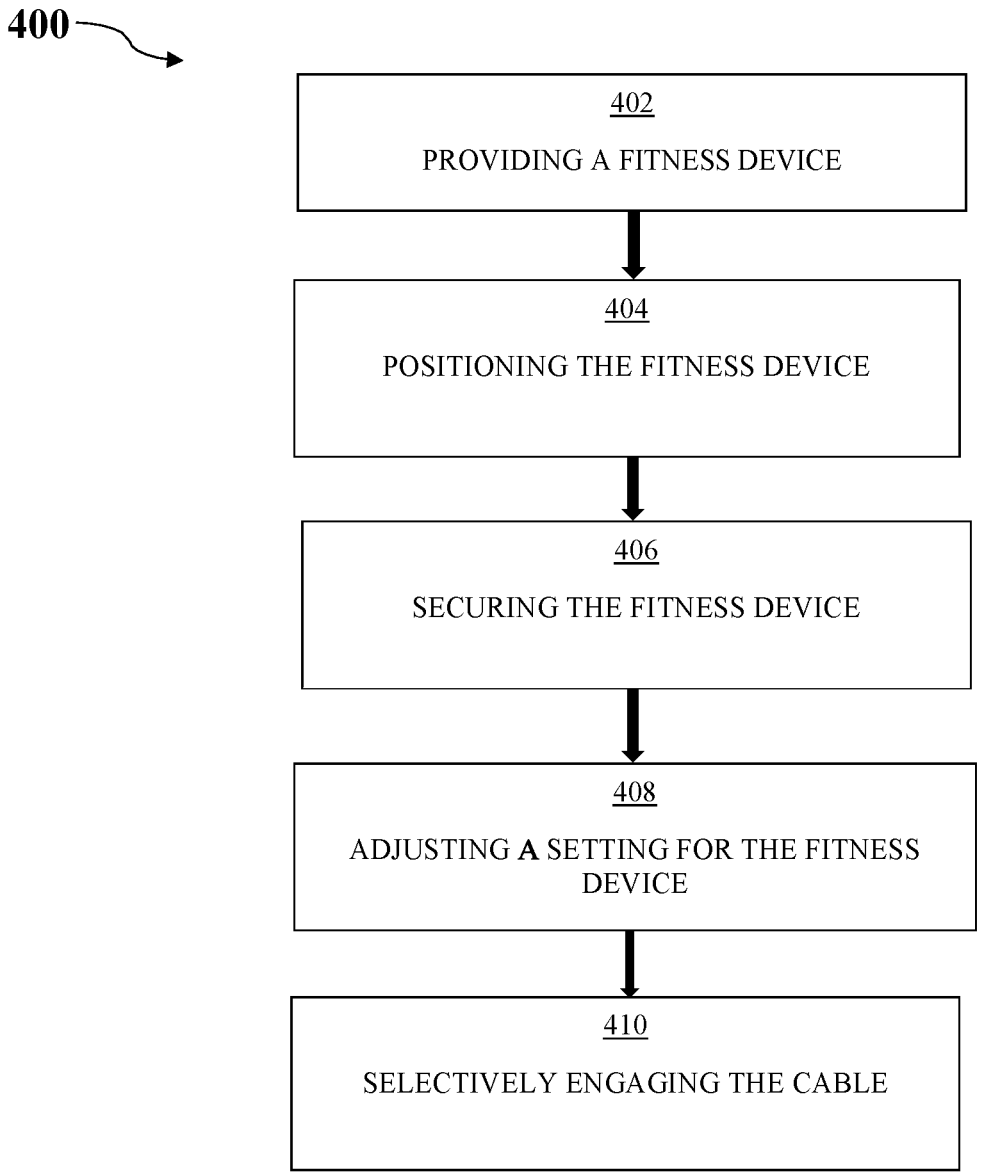

FIG. 14 in a cross-sectional view of the knob of the fitness device of FIG. 9;

FIG. 15 is a bottom perspective view of a brake assembly of the fitness device of FIG. 9 with the knob removed;

FIG. 16 is a top perspective view of the brake assembly and the spool assembly of the fitness device of FIG. 9 with a portion of the sidewall and the knob removed;

FIG. 17 is a top perspective view of a user using the fitness device of FIG. 9, according to an embodiment of the present disclosure;

FIG. 18 is a top perspective view of a user using a fitness system, according to another embodiment of the present disclosure;

FIG. 19 is an exploded top perspective view of the spool assembly of the fitness device of FIG. 9;

FIG. 20 is an exploded top perspective view of the front cover, a gearbox, the brake assembly, and the knob of the fitness device of FIG. 9;

FIG. 21 is a top perspective view of the pulley assembly of the fitness device of FIG. 9;

FIG. 22 is an exploded top perspective view of the left wing of the fitness device of FIG. 9; and FIG. 23 is a flowchart depicting a method of using a fitness device, according to an embodiment of the present disclosure.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-8, a fitness device 100 for full body fitness is shown. The fitness device 100 may have a main body 102, a left wing 104, and a right wing 106. The main body 102 may be centrally positioned between the left wing 104 and right wing 106, according to certain embodiments, such that the left wing 104 and right wing 106 extend outwardly in opposite directions from the main body 102 and from one another. The main body 102, the left wing 104, and the right wing 106 may be manufactured from wood, metal, plastic, composite, or any other suitable material or combination of materials, as determined by one of skill in the art. It should be appreciated that a skilled artisan may employ different materials for constructing the main body 102, the left wing 104, and the right wing 106.

Each of the left wing 104 and the right wing 106 may be integral with the main body 102 or may be permanently or removably connected to main body 102. In certain embodiments, each of the left wing 104 and the right wing 106 may be configured to rotate with respect to the main body 102 between an in-use position, as shown in FIGS. 1-8, where the left wing 104 and the right wing 106 extend outwardly in opposite directions from the main body 102, and a storage position (not shown) where the left wing 104 and the right wing 106 are positioned adjacent one another and extend downwardly away from the main body 102. Any suitable connecting mechanism 107, such as a torque hinge or friction hinge, as non-limiting examples, may be used to rotatably connect each of the left wing 104 and the right wing 106 to the main body 102.

A left wing 104 locking mechanism and a right wing 106 locking mechanism may be included in certain embodiments (not shown). As one non-limiting example, one or more quick release ball lock pins may be used. Any suitable means for securing the left wing 104 and the right wing 106 in the in-use position, the storage position, or any desired position there between may be included, as determined by one of skill in the art.

In certain more particular embodiments, mounting equipment (not shown) may be integral with or permanently or removably connected to one or more of the main body 102, the left wing 104, and the right wing 106. Mounting equipment may include clamps, straps, and mounting screws, as non-limiting examples. Mounting equipment may be configured to removably or permanently secure the fitness device 100 to any surface or object in any desired orientation. A person of skill in the art may employ any suitable mounting equipment, as desired.

Figure 10:
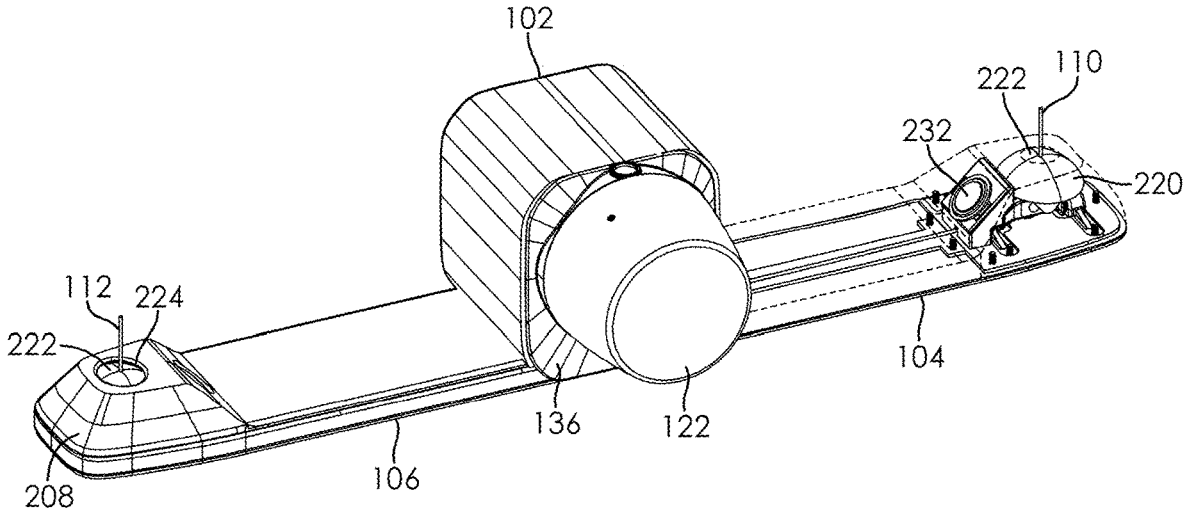
FIG. 10 is top perspective view of the fitness device of FIG. 9 showing a left wing with the footboard removed.
Figure 11:
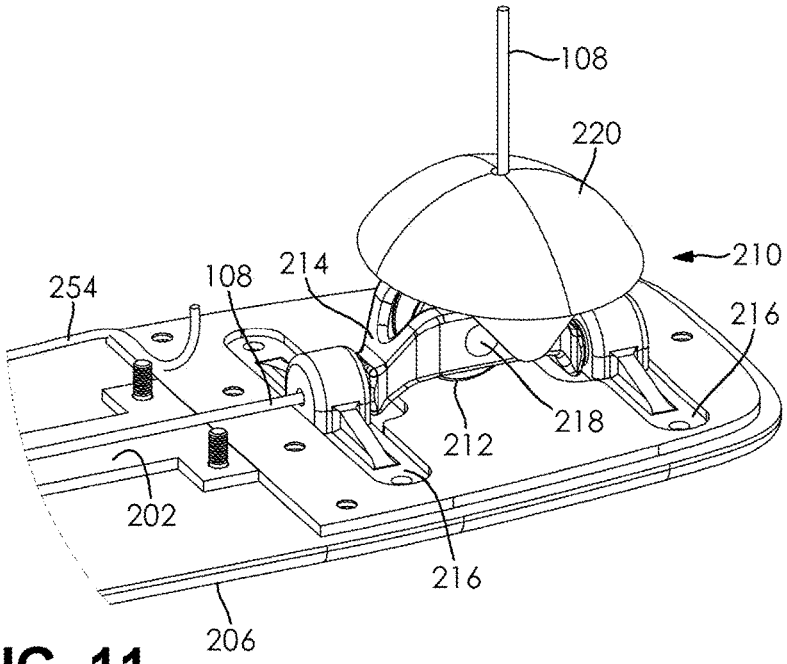
FIG. 11 is a top perspective view of a pulley assembly disposed on the left wing of the fitness device of FIG. 9 with the footboard removed.

With reference to FIGS. 9-11, a cable 108 may be disposed in one or more of the main body 102, the left wing 104, and the right wing 106. A left end 110 of the cable 108 may extend from the main body 102 to the left wing 104 of the fitness device 100 and a right end 112 of the cable 108 may extend from the main body 102 to the right wing 106 of the fitness device 100. In certain embodiments, a first cable (not shown) may extend from the main body 102 to the left wing 104 of the fitness device 100 and a second cable (not shown) that is separate from the first cable may extend from the main body 102 to the right wing 106 of the fitness device 100. It should be appreciated that the fitness device 100 may include one cable 108 with opposing ends extending in opposite directions or more than one cable 108.

The cable 108 may be fabricated using any flexible, durable material or combination of materials. Desirably the cable 108 may be fabricated using a strong, lightweight material. A skilled artisan may determine any suitable length and diameter for the cable 108. According to certain embodiments, each of the left end 110 of the cable 108 and the right end 112 of the cable 108 may include a cable attachment means 114 configured to receive a handle 116 or other accessory, as shown in FIGS. 17 and 18. As one non-limiting example, the cable attachment means 114 may be a loop, as shown in FIG. 9. The loop may be adapted to receive a carabiner clip, snap hook, or any other suitable connecting element disposed on a handle 116, strap, belt, or any other desired accessory. In certain embodiments, as shown in FIGS. 17 and 18, a cable locking mechanism 118 may be included on each of the left end 110 of the cable 108 and the right end 112 of the cable 108 in order to militate against the cable 108 rewinding beyond a desired point.

The main body 102, according to certain embodiments, may include a central housing 120 and a knob 122. The central housing 120 may include a front cover 124, a rear cover 126, and at least one sidewall 128, and may be configured to house one or more of the cable 108, a gearbox 130, a brake assembly 132, and a spool assembly 134. The knob 122 may be disposed on an outer surface 136 of the central housing 120 and may house and be in communication with the brake assembly 132. The knob 122 may be further configured to adjust resistance with respect to the gearbox 130 when the fitness device 100 is in use. The knob 122 may be manipulated manually or mechanically, according to various embodiments. Any suitable material or combination of materials may be used for the central housing 120 and the knob 122, as determined by one of skill in the art. The central housing 120 including the front cover 124, the rear cover 126, and the at least one sidewall 128, as well as the cable 108, the gearbox 130, the brake assembly 132, the spool assembly 134, and the components thereof may be connected to one another using any suitable connecting elements 138. As non-limiting examples, one or more various fasteners, screws, sockets, friction fit, threading, glue, and other adhesives may be used, as determined by one of skill in the art.

In certain embodiments, as shown in FIG. 19, the cable 108 may be coiled on the spool assembly 134 housed in the central housing 120. The spool assembly 134 may be connected to an input end 140 of the gearbox 130. The spool assembly 134 may include at least one central spool 142 and at least one return spring 144, according to certain embodiments. The spool assembly 134 may further include a spring cap 146 including a plurality of spring magnets 148, a spring lock 150, and a spring washer 152, as determined by one of skill in the art. The return spring 144 may be configured to automatically rewind the cable 108 onto the central spool 142.

Figure 12:
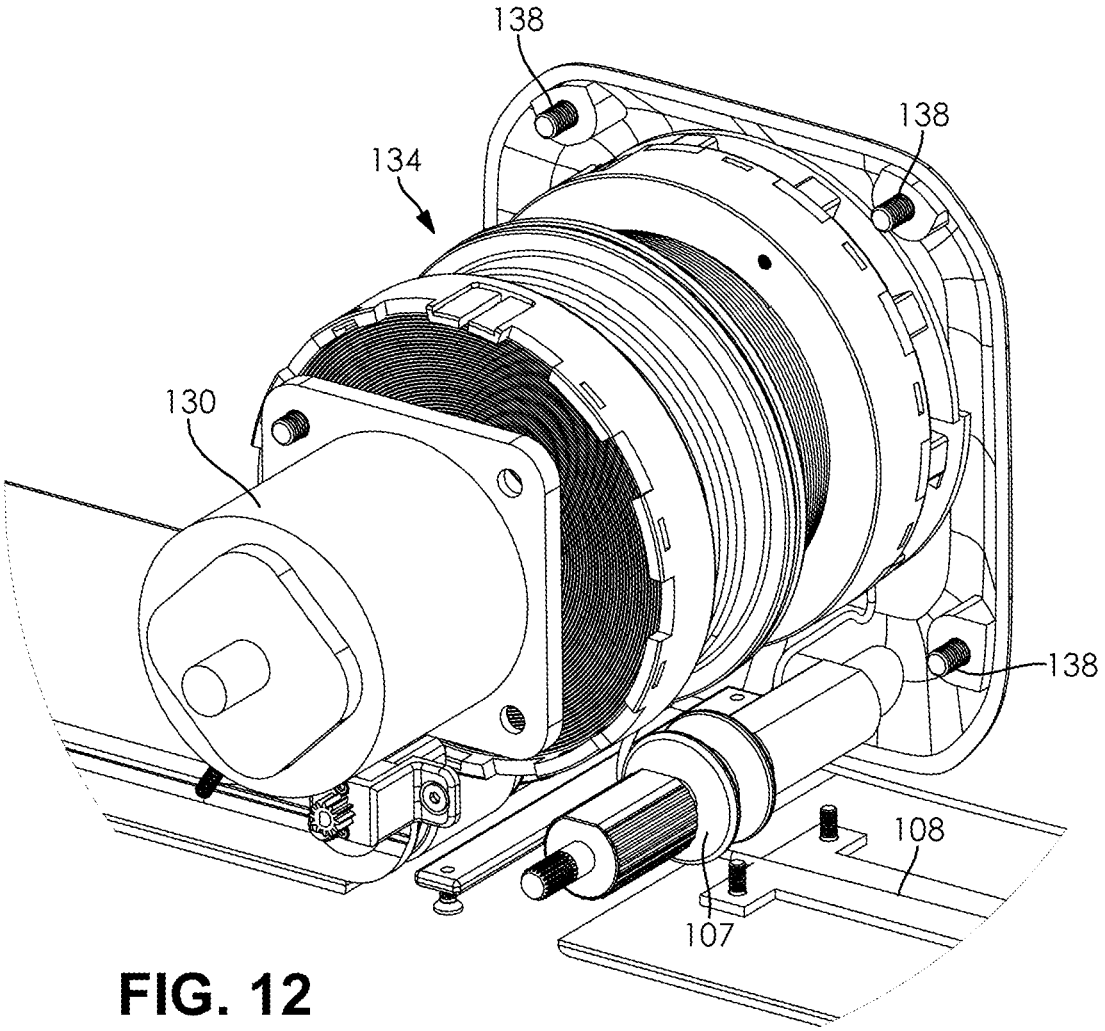
FIG. 12 is a top perspective view of a spool assembly of the fitness device of FIG. 9 with the sidewall and front cover of the central housing removed.
Figure 13:
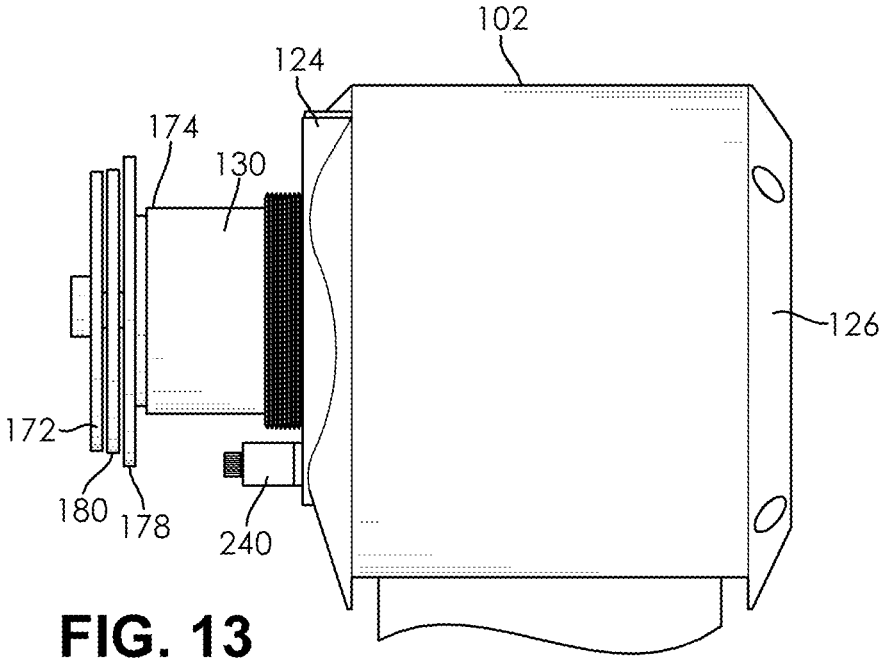
FIG. 13 is a left side elevational view of the main body of the fitness device of FIG. 9 with the knob removed.

In certain more particular embodiments, as shown in FIGS. 9, 12, and 16, the spool assembly 134 includes a right central spool 154 and a left central spool 156 that is positioned adjacent the right central spool 154. The left end 110 of the cable 108 may be coiled around the left central spool 156 and the right end 112 of the cable 108 may be coiled around the right central spool 154. Each of the left central spool 156 and the right central spool 154 may have an outer surface 158 having a conical shape configured to properly align the cable 108 when the cable 108 is rewinding. It should be appreciated that a skilled artisan may employ any suitable central spool 142 and any number of central spools 142.

In another more particular embodiment, a right return spring 160 may be positioned adjacent the right central spool 154 and a left return spring 162 may be positioned adjacent the left central spool 156. Each of the left return spring 162 and the right return spring 160 may be adapted to rewind the cable 108 onto each of the left central spool 156 and the right central spool 154, respectively, after the user extends the cable 108 during an exercise program.

The spool assembly 134, according to certain embodiments, may be connected to the input end 140 of the gearbox 130. As one non-limiting example, a one-way bearing 164 configured to transmit torque from the spool assembly 134 to the gearbox 130 in a first direction 166 when the user pulls on the cable 108 may be used to connect the spool assembly 134 to the gearbox 130. The one-way bearing 164 prevents the gearbox 130 from rotating in a second direction 168 opposite the first direction 166 when the cable 108 is rewinding. In certain more particular embodiments, the right central spool 154 may connect to the gearbox 130 using a first one-way bearing 170 and the left central spool 156 may connect to the gearbox 130 using a second one-way bearing (not shown).

The gearbox 130 may be any suitable gearbox 130, as determined by one of skill in the art. In certain embodiments, a multi-stage planetary gearbox 130 having helical gears may be used to optimally transmit force. In certain more particular embodiments, the gearbox 130 may be configured to achieve a gear ratio up to or exceeding 1:33, thereby multiplying the torque by a factor of thirty-three. It should be appreciated that a skilled artisan may scale the gearbox 130 ratio to be higher or lower, within the scope of this disclosure. It should be further appreciated that one skilled in the art may employ different technologies for the gearbox 130, as desired.

The brake assembly 132, as shown in FIGS. 13-16 and 20, may include a brake disc 172 connected to an output end 174 of the gearbox 130 using any suitable connecting mechanism. As one non-limiting example, a hexagonal slot (not shown) may be used to connect the brake disc 172 to the gearbox 130, however, any suitable connecting mechanism may be used. The brake disc 172 may include a plurality of holes 176 configured to dissipate heat during use. The brake assembly 132 may further include a brake shoe 178, a brake liner 180, a brake shoe spacer 182, a spring support 184 connected to the knob 122, a plurality of springs 186, and a spring bushing 188. The spring support 184 may be threadingly connected to the knob 122, in one non-limiting example. The plurality of springs 186 may be positioned between the spring support 184 and the spring bushing 188 and configured to apply force to, or reduce the force applied to, the spring bushing 188 as the knob 122 is turned. Increasing force applied to the spring bushing 188 increases force applied to the brake shoe 178, the brake liner 180, and the brake disc 172, thereby making it more difficult for the gearbox 130 to turn and increasing resistance as the user pulls on the cable 108. It should be appreciated that the brake assembly 132 may include any suitable braking technologies and methods. As non-limiting examples, friction braking technologies, electric braking technologies, fluid braking technologies, and air braking technologies may be used.

With renewed reference to FIGS. 1-8 and with reference now to FIG. 22, each of the left wing 104 and right wing 106 may include a center portion 190 disposed between a first end 192 adjacent the main body 102 and a second end 194 disposed opposite the first end 192. According to certain embodiments, the center portion 190 may be a flat, durable component with a bottom end 196 adapted to abut a surface and a top end 198 adapted to receive a user's foot during use.

In certain more particular embodiments, each of the left wing 104 and the right wing 106 may include a footboard 200, a base 202, a foot pad 204 disposed at the top end 198, and a base pad 206 disposed at the bottom end 196. The footboard 200, base 202, foot pad 204, and base pad 206 may be integral with one another or may be permanently or removably connected to one another. The footboard 200, base 202, foot pad 204, and base pad 206 may be made from any suitable material or combination of materials, as determined by one of skill in the art. As non-limiting examples, the footboard 200 and the base 202 may be fabricated using plastic, metal, or polycarbonate, the foot pad 204 may be fabricated using polyurethane, rubber, or anti-microbial memory foam, and the base pad 206 may be fabricated using polyurethane, rubber, or any durable gripping material.

In certain embodiments, each of the left wing 104 and the right wing 106 may include a wing housing 208 disposed at the second end 194 thereof. The wing housing 208 may be integral with one or both of the center portion 190 and the footboard 200, according to certain embodiments, or permanently or removably connected to one or both of the center portion 190 and footboard 200. A skilled artisan may position the wing housing 208 on each of the left wing 104 and the right wing 106 in any location and using any suitable means, as desired. The wing housing 208 may be fabricated using any suitable material or combination of materials capable of protecting components housed therein.

According to certain embodiments, each of the left wing 104 and the right wing 106 may have a pulley assembly 210, as shown in FIGS. 10-11 and 21, housed within the wing housing 208. The pulley assembly 210 may be integral with or permanently or removably connected to one or more of the footboard 200, the base 202, and the base pad 206, according to certain embodiments. However, a skilled artisan may affix the pulley assembly 210 to any location on the fitness device 100 using any suitable means, as desired. The left wing 104 pulley assembly 210 may be configured to receive the left end 110 of the cable 108 and the right wing 106 pulley assembly 210 may be configured to receive the right end 112 of the cable 108.

Each pulley assembly 210 may include an end pulley 212 disposed in the wing housing 208 of the fitness device 100 and configured to receive the cable 108. Additionally, one or more pulley mounting elements 214 and one or more pulley supports 216 may be used to secure the end pulley 212 in place within the wing housing 208 and to militate against the cable 108 becoming misaligned or skewed with respect to the end pulley 212. A shaft 218 or other connecting mechanism may be employed to secure the end pulley 212 to one or both of the pulley mounting elements 214 and the pulley supports 216, as determined by one of skill in the art.

A cover 220 may be integral with or permanently or removably connected to one or both of the pulley mounting elements 214 and the pulley supports 216. A top section 222 of the cover 220 may extend through a first opening 224 of the wing housing 208 and an exit point 226 through which the cable 108 may exit the fitness device 100 may be disposed in the top section 222 of the cover 220.

According to certain embodiments, a position of the pulley assembly 210, the pulley mounting elements 214, the pulley supports 216, and the cover 220 may be adjusted to optimize the position of one or both of the left end 110 of the cable 108 and the right end 112 of the cable 108, as needed. In a more particular embodiment, the position of one or more of the pulley assembly 210, the pulley mounting elements 214, the pulley supports 216, and the cover 220 may be slidingly or rotatably adjusted with respect to one or more of the base 202 and the footboard 200 of the fitness device 100, thereby militating against wear and tear of the cable 108, especially at the exit point 226, during a variety of different exercise programs. It should be appreciated that adjusting the position of one or more of the pulley assembly 210, the pulley mounting elements 214, the pulley supports 216, and the cover 220 may increase the lifespan of the cable 108 and the fitness device 100 by militating against friction between the cable 108 and the exit point 226. In one more particular embodiment, the user may pull the cable 108 at an angle of twenty-five degrees in four directions by adjusting the position of the pulley supports 216 at a first location 228 and along a first axis and by further adjusting the position of the cover 220 at a second location 230 and along a second axis that is perpendicular to the first axis.

It should be appreciated that any number and orientation of pullies may be employed, as determined by one of skill in the art. As one non-limiting example, a straight pulley (not shown) and an inclined pulley (not shown) may be disposed in the wing housing 208 and used in concert to properly align the cable 108 with respect to the main body 102 and the exit point 226 during a variety of exercise programs. As another non-limiting example, a central housing pulley (not shown) may be disposed in the central housing 120 and configured to direct the cable 108 outwardly from the central housing 120 and toward the end pulley 212.

With reference to FIGS. 1, 3, 9-10, and 22, at least one speaker 232, speaker cover 234, and speaker pad 236 may be disposed in the wing housing 208 of the fitness device 100. The speaker 232, the speaker cover 234, and the speaker pad 236 may be integral with one another or separate components and may be affixed to one or both of the wing housing 208 and the pulley assembly 210, as determined by one of skill in the art. In certain embodiments, the speaker 232 may extend through a second opening 238 in the wing housing 208. The speaker 232 may be configured to emit audio feedback, such as instructions during an exercise program, or music, as non-limiting examples. In certain embodiments, the speaker 232 may be a wireless speaker. It should be appreciated that a person skilled in the art may utilize any suitable speaker 232 and may employ the speaker 232 in any suitable way to enable more features for the fitness device 100. A speaker grill may also be provided that protects the speaker 232 from damage caused by user stepping on it. The speaker 232 may be dust and water resistant, as desired. The speaker 232 may also be placed within the central housing as a non-limiting example. Other suitable locations for the speaker 232 may also be employed, as desired.

In certain embodiments, the resistance of the fitness device 100 may be adjusted manually and electrical components may not be included. However, in certain embodiments, additional electrical components may be included, for example, in the central housing 120. With reference to FIGS. 13-16, as a non-limiting example, a motor 240 may be in communication with the knob 122 and configured to automatically turn the knob 122 in the first direction 166 or the second direction 168. In certain embodiments, the fitness device 100 may include one or more sensors 242. It should be appreciated that a skilled artisan may select any suitable sensors 242 based on the workout data to be collected. In one non-limiting example, one or more hall sensors may be included with the fitness device 100. The sensors 242 may be disposed on the brake assembly 132, the spool assembly 134, and any other component of the fitness device 100, as desired, and configured to measure workout data. Non-limiting examples of the workout data may include the resistance the user is experiencing, the number of rotations of the gearbox 130, and the speed of the rotation of the gearbox 130. Desirably, the workout data may be used to determine the intensity of the workout. It should be appreciated that a skilled artisan may select any workout data to record, as desired. In certain embodiments, the workout data may be displayed on a visual interface (not shown) disposed on the fitness device 100.

In certain more particular embodiments, the sensors 242 may include or be in communication with one or more printed circuit boards 244, contact wipers 246, and sensor magnets 248. In one non-limiting example, the contact wiper 246 may be configured to determine a current position of the knob 122, thereby allowing the sensor 242 to detect the resistance the user is experiencing. In another example, the sensor magnets 248 may be disposed on the central spool 142. Sensors 242 may be configured to detect the presence and magnitude of a magnetic field of the sensor magnets 248, thereby allowing the number of rotations of the gearbox 130 and the speed of the rotation of the gearbox 130 to be determined by the sensors 242. It should be appreciated that one skilled in the art may employ different sensor 242 technologies for measuring the workout data, within the scope of this disclosure. In certain embodiments, a plurality of printed circuit boards 244, contact wipers 246, sensors 242, batteries 250, electrical wires 252, wire covers, and sensor magnets 248, as non-limiting examples, may be included in the central housing 120 for recording workout data throughout the exercise program, as desired. The batteries 250 may be used to provide power to the fitness device 100 and any electrical components therein. It should be appreciated that other power sources may also be utilized, within the scope of this disclosure.

In certain more particular embodiments, a fitness system 300, as shown in FIG. 18, may include the fitness device 100, a software application (not shown), and a remote device 302 such as a mobile device or tablet, as non-limiting examples. The fitness device 100 and the remote device 302 may communicate with each other via a wireless connection (e.g., short range wireless Bluetooth™, internet or cloud-based communication, cellular network, and the like) and/or through a hardwired connection where the remote device 302 is connected to the fitness device via a cable or docking station. The software application may be configured to receive the workout data from the plurality of sensors 242 and display the workout data to the user on the remote device 302. The software application may also be configured to permit the user to interface with the software application to configure settings on the fitness device 100, select pre-existing exercise programs, and create unique and customized exercise programs. The exercise programs may control the fitness device 100 automatically, for example, by automatically rotating the knob 122 in the first direction 166 or the second direction 168 to match the resistance requirements of the exercise program. It should be understood that the software application may include a mobile application, desktop application, and/or web application, as determined by a skilled artisan.

The software application may be further configured to receive an auditory command from the user. Desirably, the auditory command may be used to control the fitness device 100. In certain examples, when the software application is a mobile application, the user may transmit the auditory command through a microphone on the remote device 302, which the software application may then use to control the fitness device 100. For example, the user may use an auditory command to instruct the fitness device 100 to adjust the resistance the user is experiencing using the motor 240 and the knob 122. It should be appreciated that a skilled artisan may employ different functions and features for the software application, as desired. In certain embodiments, the user may connect the fitness device 100 to the software application using Bluetooth™ technology. The software application may include exercise videos and may monitor the progress of the user using the plurality of printed circuit boards 244, contact wipers 246, sensors 242, and sensor magnets 248.

The software application may be further configured to provide a graphical user interface feature configured to automatically adjust a position of the knob 122 disposed on the main body according to a manual manipulation of the graphical user interface feature provided by a user. For example, the user can move a slider on the graphical user feature of the software application and the knob 122 rotates increasing or decreasing resistance in the equipment. Other types of graphical user interface features for adjusting the position of the knob 122 may also be used, as desired.

In use, as shown in FIGS. 17 and 18, the user may rotate the left wing 104 and right wing 106 such that the left wing 104 and the right wing 106 are secured in the in-use position. The user may then position the fitness device 100 in a desired location with a desired orientation in order to perform a particular exercise program. The selected handles 116 may be secured to the left end cable 110 and the right end cable 112, and the user may adjust various settings relating to resistance, audio, visual, tracking, or any other customizable features using the fitness device 100 and the software application. Finally, the user may begin to exercise by engaging one or both of the left end cable 110 and the right end cable 112 for a desired number of repetitions or a desired period of time.

The one-way bearing 164 may be configured to transmit rotational force when the user pulls on one or both of the left end cable 110 and the right end cable 112 to the gearbox 130 in the first direction 166 while not transmitting rotational force in the second direction 168 when the cable 108 rewinds. Advantageously, by using the same gearbox 130 and/or brake assembly 132 to rotate both the left end cable 110 and the right end cable 112, the user may experience resistance uniformly across the entire cable 108, which can militate against imbalance between the left end cable 110 and the right end cable 112.

The brake assembly 132 may be configured to gradually engage with the gearbox 130 and increase resistance by applying friction to the gearbox 130 and militating against the gearbox 130 rotating in the first direction 166. More specifically, the knob 122 may be adjusted by the user to move the brake shoe 178 inward, thereby pushing the brake liner 180 towards the brake disc 172 and gradually increasing the brake force on the gearbox 130. Advantageously, the resistance generated by the brake force to the left end cable 110 and the right end cable 112 results in the user needing to apply additional force to the cable 108 and building muscle as a result.

Advantageously, the user may adjust the position and orientation of the fitness device 100, as well as any settings relating to resistance, audio, visual, tracking, or any other customizable features, in order to attain a full body workout. The fitness device 100 is lightweight and compact in both the in-use and the storage position and is thereby easy to use, setup, transport, and store. According to certain embodiments, the fitness device 100 may weigh less than ten (10) pounds. It should be appreciated that the fitness device 100 may be secured in place using only the user's body weight, thereby allowing the user to operate the fitness device 100 without any set up or additional equipment and in any location large enough to fit the user. It should be further appreciated that the fitness device 100 may also be secured to any surface using mounting equipment or weight from an object, as needed. Advantageously, the mounting equipment may be used to affix the fitness device 100 to walls, doors, and benches, as non-limiting examples. Desirably, this may allow the user to perform exercises programs with the fitness device 100 in an elevated or otherwise unconventional position or location.

The fitness device 100 is portable and adaptable, and may be used indoors, outdoors, at home, at work, on the go, and on demand. Using the fitness device 100 in a variety of positions and orientations allows the user to exercise a variety of muscle groups in a variety of different ways. Likewise, using the fitness device 100 in combination with a variety of accessories and with a variety of training applications allows the user to create customized, inventive, and fun exercise programs.

Advantageously, the fitness device 100 is useful for any fitness level, beginner to expert, and eliminates the need to purchase and store additional equipment as exercise needs evolve. Beginner users may select zero resistance or a low level of resistance while using the fitness device 100. Expert users may increase resistance over time, as needed. More specifically, according to certain embodiments, the gearbox 130 and the brake assembly 132 may be used in combination to generate the desired resistance. The user avoids purchasing additional equipment such as free weights and adding and removing additional equipment during use of the fitness device 100. In certain more particular embodiments, the fitness device 100 may provide up to or more than three-hundred pounds of resistance.

It should be appreciated that using the same brake assembly 132 for resistance with respect to both the left end cable 110 and the right end cable 112 militates against having disproportionate resistance on one side of the fitness device 100 versus the other side of the fitness device 100, thereby allowing the user to experience a balanced exercise program benefiting the user's right and left muscle systems equally. Additionally, the pulley assembly 210 including any angular adjustments made to the pulley supports 216 at the second location 230 and the cover 220 at the first location 228 allows for a smooth user experience pulling the cable 108 from the fitness device 100 and militates against the cable 108 scraping at the exit point 226, thereby preventing unnecessary wear and tear due to friction. Advantageously, this increases the lifespan of the fitness device 100.

The conical or tapered outer surface 136 on the central spool 142 ensures that the cable 108 self-aligns on the central spool 142 without any entanglement. Advantageously, the user experiences a smoother pull of the cable 108 compared to pulling an unevenly wound spool. In certain embodiments including the first one-way bearing 170 and the second one-way bearing, the user may seamlessly switch from working out with one handle 116 to two handles 116.

Using a multi-stage planetary gearbox 130 with helical gears advantageously allows the fitness device 100 to achieve optimal gear ratios within the confined space of the main body 102. Additionally, using helical gears results in a better sound signature and lower noise levels. The larger gear ratio achieved using the gearbox 130 means only one brake assembly 132 including one brake disc 172 and one brake liner 180 is needed to adequately apply friction to the gearbox 130. Using a brake system requiring multiple friction pads undesirably results in suboptimal brake force in general and uneven brake force being applied to the left cable end 110 and the right cable 112 end. Advantageously, using a single brake assembly 132 eliminates issues relating to suboptimal and uneven brake force by relying on a single brake disc 172 and brake liner 180 and using the gearbox 130 to multiply the brake assembly's 132 effect. The resistance experienced by the user on the user's left and right sides will be the same. The gearbox 130 may be activated by pulling only one of the left end cable 110 and the right end cable 112, or by pulling both at the same time. Advantageously, using a single cable 108 militates against the user applying unequal amounts of force on one side versus another side of the fitness device 100.

Advantageously, the fitness device 100 used in combination with smart technology, such as the software application, allows the user to select an exercise program categorized and optimized using any desired criteria, such as muscle group, body system, fitness level, and workout type, as non-limiting examples. In certain embodiments, the user may create his or her own pre-programmed exercise programs using the software application in combination with the fitness device 100 and remote device 302, as one non-limiting example. Additionally, using smart technology, the user may track progress and compare workout data over time in order to measure progress.

Additional data points such as calories burned, workout duration, resistance, and number of repetitions, as non-limiting examples, may also be recorded and stored using the software application. Pre-programmed exercise programs may have embedded resistance control codes and resistance may be automatically adjusted during an exercise program. Additionally, in certain other embodiments, voice activation may be used to adjust the resistance during an exercise program.

With reference to FIG. 23, a method 400 for using the fitness device 100 may include providing the fitness device 100, in a step 402. A second step 404 may include positioning the fitness device 100 in a desired location and orientation, and a third step 406 may include securing the fitness device 100 in a selected position and orientation. As non-limiting examples, the user may utilize body weight, mounting equipment, or any other suitable means for securing the fitness device 100 in the selected position and orientation. In a fourth step 408, the user may adjust one or more settings on the fitness device 100. As one non-limiting example, the user may select a resistance level. In a fifth step 410, the user may selectively engage one or both of the left end cable 110 and the right end cable 112 during an exercise program.

It should be appreciated that additional steps may be included, as determined by one of skill in the art. As non-limiting examples, various steps relating to the setup of the fitness device 100, adjustment and customization of various components and features such as resistance levels and selected exercise programs may be included. Steps relating to the software application such as utilizing audio commands may also be included. The method 400 for using the fitness device 100 may also include repeating or omitting various steps, as needed. Advantageously, the fitness device 100, the fitness system 300, and the method 400 of using the fitness device 100 may be utilized with a multitude of settings and may be customized by the user.

Example embodiments are provided so that this disclosure will be through and fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, components and methods may be made within the scope of the present technology, with substantially similar results.

What is claimed is:

1. A fitness device, comprising:

a main body;

a left wing extending outwardly from the main body in a first direction;

a right wing positioned adjacent the left wing and extending outwardly from the main body in a second direction opposite the first direction;

a cable disposed within each of the left wing and the right wing;

a gearbox;

a spool assembly connected to an input end of the gearbox;

a sensor;

a software application configured to receive workout data from the sensor; and a pulley assembly, wherein at least one of the left wing and the right wing is configured to rotate, and wherein the software application includes at least one of a voice activation feature and a graphical user interface feature configured to automatically adjust a position of a knob disposed on the main body according to an auditory instruction or manual manipulation of the graphical user interface feature provided by a user.

2. The fitness device of claim 1, wherein the left wing and the right wing are configured to rotate with respect to the main body between an in-use position wherein the left wing extends outwardly from the main body in the first direction and the right wing extends outwardly from the main body in the second direction opposite the first direction, and a storage position wherein the left wing and the right wing extend downwardly away from the main body in a same direction.

3. The fitness device of claim 1, wherein the software application is configured to allow for a setting on the fitness device to be modified.

4. The fitness device of claim 1, wherein the software application is configured to allow for a predetermined exercise program to be selected.

5. The fitness device of claim 1, wherein the software application includes a desktop application.

6. The fitness device of claim 1, wherein the software application includes a mobile application.

7. The fitness device of claim 1, wherein the software application includes a web application.

8. The fitness device of claim 1, wherein the gearbox is a multi-stage planetary gearbox having helical gears.

9. The fitness device of claim 1, wherein the gearbox is configured to achieve a gear ratio of 1:33.

10. The fitness device of claim 1, wherein the main body includes a central housing and the knob.

11. The fitness device of claim 10, wherein the software application is configured to move the knob.

12. The fitness device of claim 1, wherein the software application includes an augmented reality application.

13. The fitness device of claim 1, wherein each of the left wing and the right wing includes a speaker.

14. A fitness device, comprising:

a main body;

a left wing extending outwardly from the main body in a first direction;

a right wing positioned adjacent the left wing and extending outwardly from the main body in a second direction opposite the first direction;

a cable disposed within each of the left wing and the right wing;

a gearbox;

a spool assembly connected to an input end of the gearbox;

a sensor;

a software application configured to receive workout data from the sensor; and a pulley assembly, wherein:

a right pulley assembly configured to receive a right end of the cable is disposed in the right wing of the fitness device and a left pulley assembly configured to receive a left end of the cable is disposed in the left wing of the fitness device, and the right pulley assembly includes a right end pulley, a right pulley mounting element, a right pulley support, and a right cover, and wherein the right cover extends through an opening in the right wing, and the left pulley assembly includes a left end pulley, a left pulley mounting element, a left pulley support, and a left cover, and wherein the left cover extends through an opening in the left wing, a right exit point disposed on the right cover is adjustable with respect to the fitness device by adjusting a position of the right pulley support at a first location and along a first axis and by adjusting a position of the right cover at a second location and along a second axis that is perpendicular to the first axis, and a left exit point disposed on the left cover is adjustable with respect to the fitness device by adjusting a position of the left pulley support at a first location and along a first axis and by adjusting a position of the left cover at a second location and along a second axis that is perpendicular to the first axis.

15. A fitness system, comprising:

a fitness device including a main body, a left wing extending outwardly from the main body in a first direction, a right wing positioned adjacent the left wing and extending outwardly from the main body in a second direction opposite the first direction, a cable disposed within each of the left wing and the right wing, a gearbox, a spool assembly connected to an input end of the gearbox, a sensor a software application configured to receive workout data from the sensor, a pulley assembly, wherein at least one of the left wing and the right wing is configured to rotate, and wherein the software application includes at least one of a voice activation feature and a graphical user interface feature configured to automatically adjust a position of a knob disposed on the main body according to an auditory instruction or manual manipulation of the graphical user interface feature provided by a user; and a remote device.

16. The fitness system of claim 15, wherein the software application is configured to allow the user to select an exercise program using the remote device.

17. A method of using a fitness device, comprising:

providing a fitness device including a main body, a left wing extending outwardly from the main body in a first direction, a right wing positioned adjacent the left wing and extending outwardly from the main body in a second direction opposite the first direction, a cable disposed within each of the left wing and the right wing, a gearbox, a spool assembly connected to an input end of the gearbox, a sensor a software application configured to receive workout data from the sensor, and a pulley assembly, wherein at least one of the left wing and the right wing is configured to rotate, and wherein the software application includes at least one of a voice activation feature and a graphical user interface feature configured to automatically adjust a position of a knob disposed on the main body according to an auditory instruction or manual manipulation of the graphical user interface feature provided by a user;

positioning the fitness device in a selected position;

securing the fitness device in the selected position;

adjusting a setting on the fitness device using the software application; and selectively engaging the cable in one of the left wing and the right wing.

* * * * *